United States Patent [19]

Rizzo et al.

[11] 3,952,690

[45] Apr. 27, 1976

[54] HIGHWAY BARRICADE

[75] Inventors: Rudolph R. Rizzo, Longwood, Pa.; Gabriel L. Julian, Hockessin, Del.

[73] Assignee: Flexicade Ltd., Elsmere, Wilmington, Del.

[22] Filed: Aug. 28, 1972

[21] Appl. No.: 284,186

Related U.S. Application Data

[63] Continuation-in-part of Ser. No. 218,758, Jan. 18, 1972, abandoned.

[52] U.S. Cl. ..... 116/63 P; 116/63 C; 350/102

[51] Int. Cl.[2] ..... E01F 9/01; G02B 5/122

[58] Field of Search ..... 116/63 R, 63 P, 63 C; 40/125 J; 404/6, 9; 73/356; 350/102, 302

[56] References Cited

UNITED STATES PATENTS

| | | | |
|---|---|---|---|
| 2,333,273 | 11/1943 | Scanlon | 116/63 P |
| 2,625,130 | 1/1953 | Morser | 116/63 P |
| 2,957,444 | 10/1960 | Boettler | 116/63 P |
| 3,147,734 | 9/1964 | Knapp | 116/63 P |
| 3,247,823 | 4/1966 | Buck et al. | 116/63 P |
| 3,339,920 | 9/1967 | Moritz | 182/181 X |
| 3,380,428 | 4/1968 | Abrams | 116/63 P |
| 3,451,368 | 6/1969 | Keats | 116/63 P |
| 3,496,904 | 2/1970 | Rimkus | 116/63 P |
| 3,540,282 | 11/1970 | Kohler et al. | 73/356 |
| 3,596,628 | 8/1971 | Wright | 116/63 P |
| 3,696,237 | 10/1972 | Whitehead | 116/63 P |

FOREIGN PATENTS OR APPLICATIONS

| | | | |
|---|---|---|---|
| 891,693 | 3/1962 | United Kingdom | 116/63 P |
| 951,684 | 3/1964 | United Kingdom | 116/63 P |
| 1,498,633 | 9/1964 | France | 116/63 P |
| 281,360 | 6/1952 | Switzerland | 116/63 P |
| 1,058,881 | 2/1967 | United Kingdom | 116/63 P |
| 1,375,270 | 9/1964 | France | 116/63 P |

*Primary Examiner*—Richard C. Queisser
*Assistant Examiner*—Daniel M. Yasich
*Attorney, Agent, or Firm*—Beveridge, DeGrandi, Kline & Lunsford

[57] ABSTRACT

A highway barricade which has an appearance similar to that of a large steel drum is formed of an organic polymer. The sidewalls of the barricade are slightly tapered to permit the nesting together of a plurality of similar units, and the base portion thereof is provided with weighting means to permit it to withstand normal forces encountered in highway situations. Visibility of the device is enhanced by incorporating fluorescent, phosphorescent and/or reflective materials in the polymer; by providing faceted surfaces; and/or by locating a light source inside a translucent barricade.

5 Claims, 11 Drawing Figures

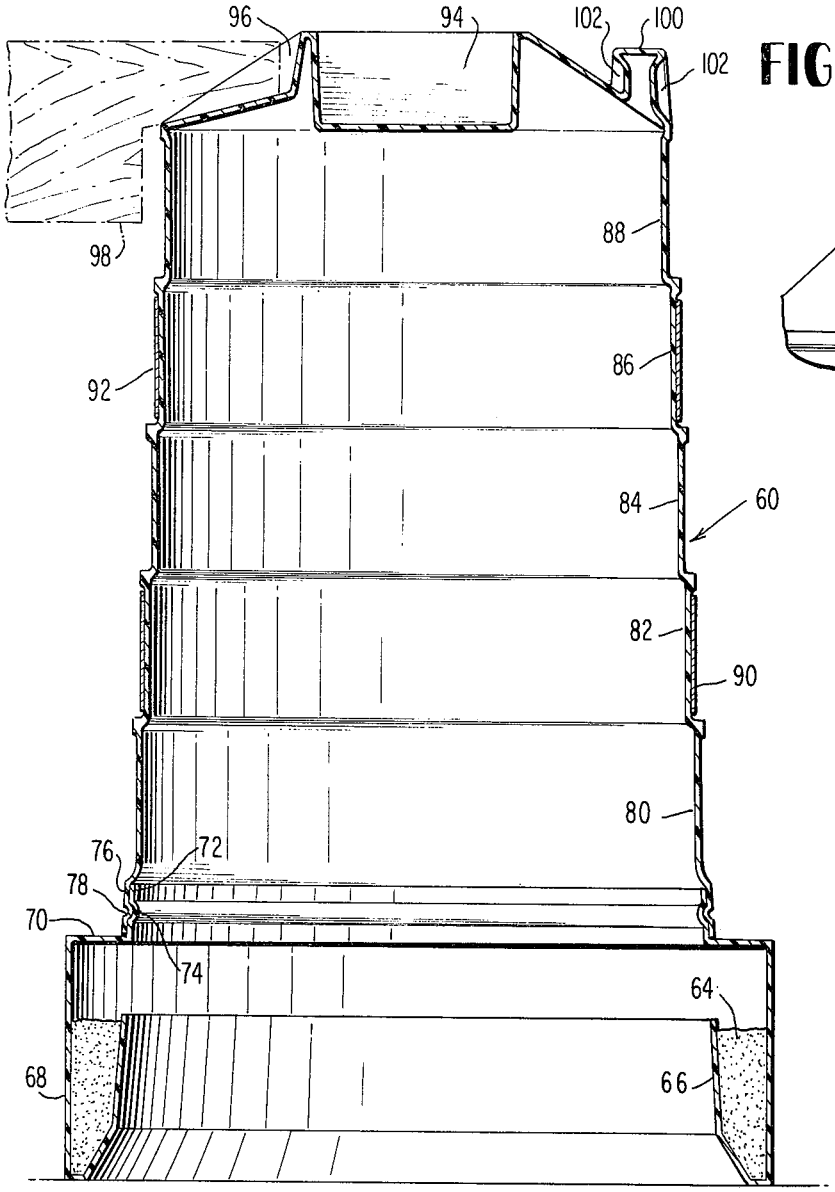
FIG. 8
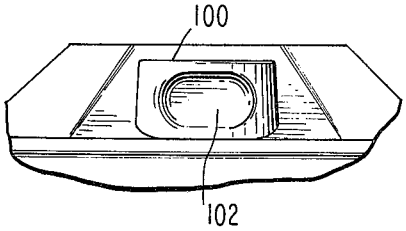
FIG. 10
FIG. 11
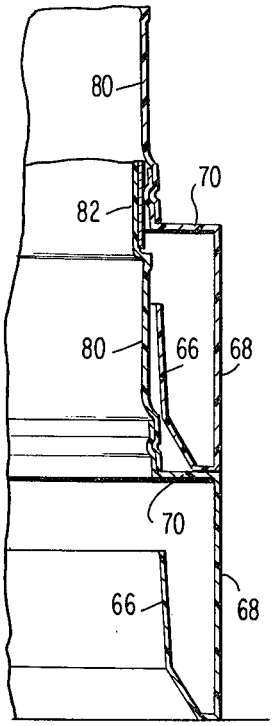
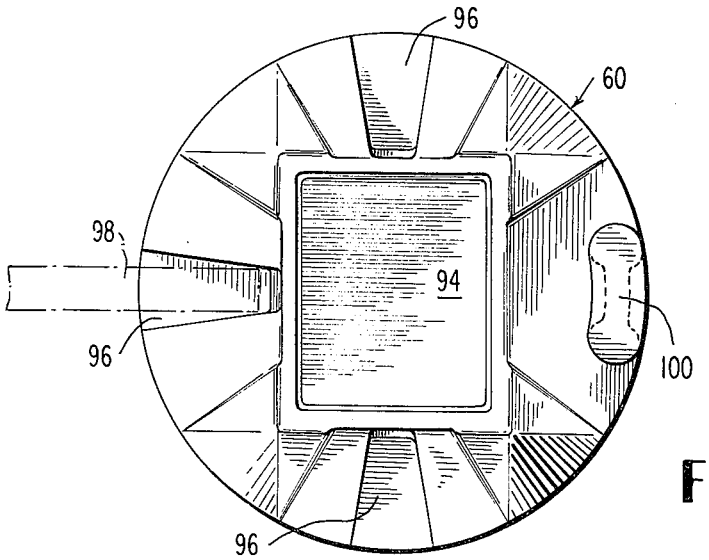
FIG. 9

HIGHWAY BARRICADE

This is a continuation-in-part of our application Ser. No. 218,758 filed Jan. 18, 1972, now abandoned, for a highway barricade.

This invention is concerned with a novel type of highway barricade which presents the general appearance of typical steel drums which are currently in use in areas of highway constructions.

The steel drums presently used as highway markers are quite effective for their intended purpose, but their expense and vulnerability to collision have been detracting factors to potential users. Such drums are usually purchased on a large scale and must be painted and banded with reflective material before they can be placed in service. While in service, they are frequently struck by highway and construction vehicles, often resulting in considerable damage both to the vehicles and the drums which then must be discarded. When not in service, steel drums create a substantial storage problem due to the considerable volume which they occupy in a warehouse, on the construction yard or in a truck which is carrying the drums.

This invention provides an alternative drum-like barricade which avoids many of the disadvantages inherent with the steel drum barricades. The barricade of the present invention can be sold at a price which compares favorably with that of steel drums, it does not have to be painted and it has approximately the same stability as steel drums when subjected to wind and impact forces. The barricade of this invention is made of a resilient organic polymer such as high density polyethylene, plasticized vinyl or polyvinyl chloride, and therefore it does not become permanently deformed when struck by vehicles. This invention also can provide a barricade of high night visibility. An extremely important advantage of barricades constructed according to this invention is that they may be nested together so as to consume a minimum of space when in storage or in transit to the construction site.

Prior to our development it was known that highway barricades having a drum-like configuration may be made out of flexible plastic material, weighted with sand and provided with tapered walls which permit nesting of the barricades. These prior barricades had sand-receiving receptacles attached to and extending downwardly from their upper ends, with the sand therein being located approximately at the elevation which would be struck by vehicular traffic. Before such barricades could be nested together, it was necessary to remove the sand.

Unlike the prior art, the present invention provides a weighting means which is attached to a lower portion of the barricade. Preferably, the weighting means is placed and distributed so that it will not interfere with the nesting of a plurality of such barricades. According to a preferred embodiment, the sand is located in an annular trough which is open upwardly to the interior of the barricade so that, when toppled, the sand will remain in the barricade and not be lost.

According to another aspect of the invention, the barricade is made in at least two sections including a lower weighted section and a break-away upper section which is releasable from the lower section upon being struck by an automobile. The advantages attributable to this is that it reduces the impact-produced forces so as to minimize the damage to the barricade and to the automobile which strikes it. Perhaps a more important advantage is that it reduces the possibility that a weighting means will be thrown as a projectile into traffic or at pedestrians when the barricade is struck by a vehicle.

According to this invention, the main body of the barricade has upright sidewalls which are symmetrically arranged about a central vertical axis. The sidewalls converge upwardly toward the axis to permit nesting of a number of main bodies. When in use, the barricade has weighting means at a lower portion of the main body to stabilize the barricade and prevent its tipping when subjected to the normal forces of such use.

Another aspect of the invention involves the utilization of fluorescent particles in a main body formed of an organic polymer such as high density polyethylene. An excitation energy source, preferably a source of ultraviolet light, is located within the main body and directed against the walls thereof so as to excite the fluorescent particles and make the barricade visible to drivers at night.

Another feature of the invention involves a drum-like device which has an upper cap portion provided with a recess for receiving a flashing light unit and one or more radiating notches, each of which is capable of receiving and supporting a beam-shaped barricade element. This particular cap construction adds to the convenience of using spaced pairs of the drum-like barricades for supporting beam-type barricades.

Still another feture of the invention resides in the presence of a multi-faceted surface which enhances the light-reflective properties of the article and, when on the exterior surface, also reduces wind drag.

In its preferred form, the weighting means for the barricade is a high density annular body located at the base of the main body and permanently attached thereto. The weighting means is located radially outwardly from the lower portion of the main body in order to permit the stacking and nesting of a plurality of such barricades.

The construction of a preferred embodiment of the invention is shown in the accompanying drawings wherein FIG. 1 is a perspective view of a highway barricade constructed according to the invention, broken away to show the sidewall configuration and internal construction thereof;

FIGS. 8–11 are views of a preferred form of the invention wherein FIG. 8 is a sectional view thereof; FIG. 9 is a plan view; FIG. 10 is an elevational view of the handle portion; and FIG. 11 shows two such devices nested together for storage or transportation.

Figure 1:
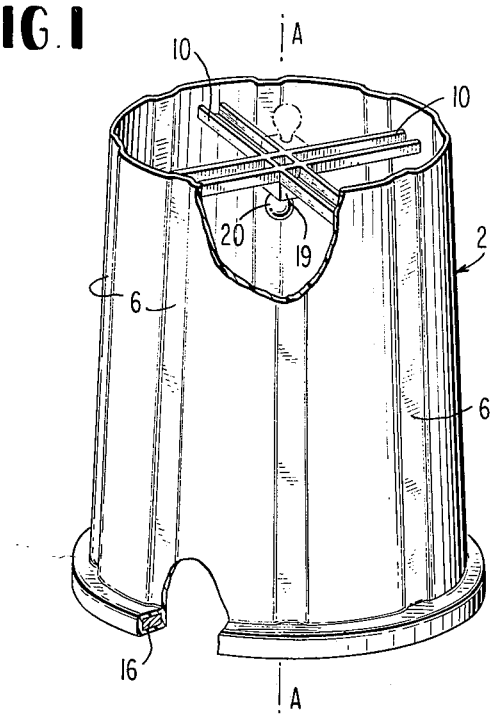

Referring to FIG. 1, it will be seen that the barricade of this invention has an appearance quite similar to that of 55 gallon drums which are frequently used to mark hazardous areas of highway construction. The barricade has approximately vertical sidewalls which are symmetrically arranged about the central vertical axis A—A of the device. The sidewall is preferably circular in horizontal cross section, but it may take other forms without departing from the invention.

Reinforcing ribs 6 are formed in the sidewalls to impart structural strength to the device, and the upper end of the main body is provided with integral radiating reinforcing channels 10 which may readily be grasped for handling the barricade. The area between the channels may be open as illustrated, or it may be continuous to close off the upper end of the device.

The sidewalls, unlike those of a conventional steel drum, are tapered to converge upwardly toward the axis A—A to permit nesting of a plurality of identical units of this construction. In a main body having the height of 33 inches, the taper is such that the diode diameter at the lower end of the sidewalls is 24 inches and the outside diameter at the upper ends of the sidewalls is 20 inches. The reinforcing ribs 6 extend about one wall thickness radially inwardly from the adjacent portions of the sidewalls 2.

The main body which includes the sidewall 2 and channels 10 is preferably formed of an organic polymeric material such as high density polyethylene or plasticized vinyl which possesses sufficient resilience to withstand the impact of vehicular traffic without sustaining any damage. In order to avoid the necessity of painting the device, the plastic material used in forming the main body may include pigments having the appropriate colors and other characteristics. It is expected that fluorescent and phosphorescent pigments will be used to provide maximum visibility and, if desired, to furnish night visibility in a manner described in a later portion of this specification. It is also possible to include reflective materials in the plastic material prior to molding of the main body to improve its visibility.

Figure 2:
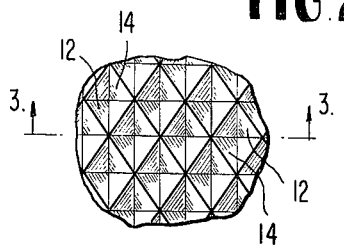
FIGS. 2 and 3 show a reflective external surface texture for the main body of the barricade.
Figure 3:
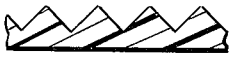

It has been found that the night visibility of the barricade is enhanced by providing a faceted pattern to the surfaces of the sidewall 2. The exterior surface of the sidewall should be clear and glossy and may be coated to maximize its reflective properties. One suitable pattern is shown in FIGS. 2 and 3 where each indented pattern unit is about 0.1 inch on each side, with each face of the pattern unit oriented at 45° to a plane which lies tangent to the sidewall at that point. This causes light rays which are incident upon one face 12 of a pattern unit to be reflected and strike the opposing face 14 on the same pattern unit which, in turn, reflects it back toward the light source. The reflective nature of the barricade is improved by making it of a transparent plastic such as polyvinyl chloride which is formulated with reflective bodies such as glass beads.

The light reflected by barricades using this principle will not change in color, so that the generally white light directed thereon by an automobile will be reflected as white light, regardless of the color of the barricade.

Figure 4:
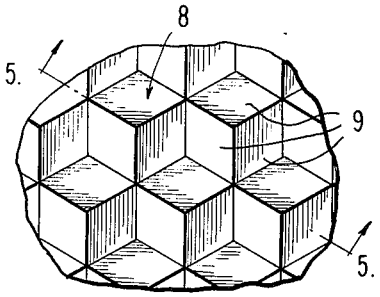
FIGS. 4 and 5 show a suitable internal surface texture for a transparent prismatically reflective barricade.
Figure 5:
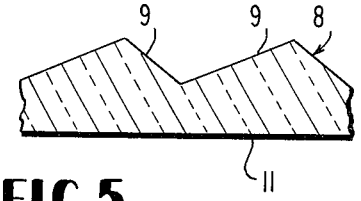

Alternatively, the faceted surface may be located on the interior wall of a barricade made of transparent material to provide a conventional prismatic reflection. FIGS. 4 and 5 illustrate a faceted pattern of this latter design.

The interior surface 8 of this design is formed by a plurality of adjacent three-sided pyramidical prisms sometimes called cube-corners, each of which has three planar faces 9. Light passes through the outer surface 11 of the barricade, is reflected by the planar faces 9 and then reflects back through the sidewalls to provide the needed visibility. The reflective efficiency may be increased by coating the interior wall of the barricade. The color of the reflected light will be either the color of the transparent sidewalls or the interior coating. Contrasting orange and white stripes will conform to current safety rules. In the case of either internally or externally reflective barricades, the reflecting faces may be curved, but preferably they are planar as shown.

Night visibility may also be improved by making the device of translucent material and placing a flashing or continuous light source inside the drum. One such unit, shown in FIG. 1, includes a power source 19 and a lamp 20. Conventional visible light flasher units have been used satisfactorily. Such a unit may be held by suitable clips to the channels 10, either internally of the barricade as shown in FIG. 1, or externally thereof as shown in broken lines. If there are fluorescent pigments in the sidewalls, an ultraviolet lamp may be used as the excitation energy source for the pigments to provide a unique and noticeable form of illumination for the barricade disclosed herein. If desired, the pigments may be selected to give a different coloring effect for day and night uses. For example, a drum which is orange when subjected to sunlight may give off yellow light when energized by ultraviolet light at night.

Since the weight of the barrel-simulating main body formed of plastic materials is considerably less than that of a conventional steel drum, it is desirable to incorporate some type of weighting means in this improved device. The weighting means may be a cast iron ring 16 embedded in the base of the main body and permanently attached thereto. It will be noted that the weighting ring 16 and the plastic which encases it extend radially outwardly from the main body to prevent its interference with the nesting of a plurality of such bodies.

There is a preferred relationship between the dimensions of various portions of the apparatus, measured relative to the central axis A—A. The reference or datum measurement, denoted $x$, is the maximum distance between the interior surfaces of the sidewalls which in the illustrated structure is at the lower portion thereof. The minimum distance between the sidewalls should be no less than about $0.75x$ at the upper end of the main body, and the maximum radial dimension of the weighted base is no more than $1.2x$.

Figure 6:
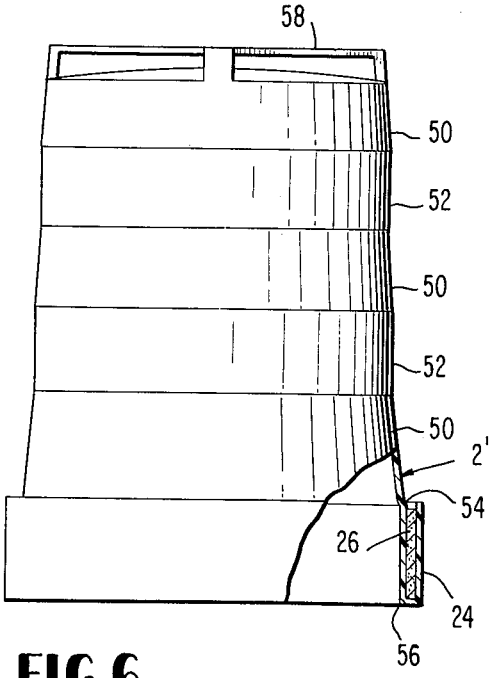
FIG. 6 illustrates another form of the invention.

FIG. 6 shows an alternative form of the invention wherein the weighting means includes an upturned flange 24 which is formed of the same material and is integral with the sidewalls 2' of the main body. This flange 24, together with the sidewall of the main body forms a trough-like receptacle which may be filled with a weighting material 26 of particulate nature such as sand, or of a more permanent nature such as concrete.

The sidewall of the device of FIG. 6 is tapered in several steps, in that there are truncated conical sections 50 located between cylindrical sections 52. This is advantageous in three respects. First, it permits a convenient application of bands of reflective tape which are more easily wrapped around cylindrical sections 52 than around a tapered section. Second, the changes in taper give the barricade added rigidity in the circumferential direction. Third, the taper beneath each cylindrical section prevents the tape from slipping downwardly on the barrel in instances when there is poor adhesion between the reflective tape and the underlying polymer surface. The upper edge of the lowermost cylindrical section 52 projects radially to form a shoulder 54 which serves as a stop when nesting a plurality of barricades. This shoulder 54 will be abutted by the lower inside corner 56 of the next barricade and prevents the wedging together of the tapered sidewalls.

It is envisioned that the barricade of FIG. 6 will be made of a translucent organic polymer formulated with orange phosphorescent pigments. Either the interior or exterior surface of the conical portions may be given any texture suitable to give it the desired light-reflective properties as described in connection with FIGS. 2–5. For ease of handling, a handle 58 is integrally molded with the body of the barricade of FIG. 6.

Figure 7:
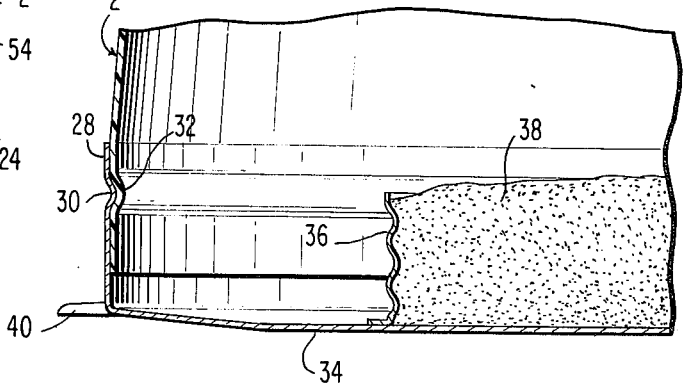
FIG. 7 shows an alternative type of weighting means which may be used.

FIG. 7 shows a further alternative form of the invention wherein a removable base member is located at the lower end of the main body. This base member may be formed of any suitable material and has a generally cylindrical upstanding wall 28 with an annular indentation 30 which is received in a similar indentation 32 in the sidewall 2″. A bottom member 34 is permanently connected to the wall 30 and includes a receptable 36 at its center for receiving sand or other weighting material 38. The bottom wall has a small projection 40 which extends about 2 or 3 inches which is useful in disassembling the apparatus.

The apparatus of FIG. 7 is assembled by first placing the base which includes the wall 28 and bottom 34 on the ground, filling the receptacle 36 with a dense weighting material and then telescoping the main body with the sidewalls 2″ into the base until the projections 30 and 32 retain these elements together. The apparatus is easily disassembled by a workman by placing his foot on the projection 40 and lifting the main body with sidewalls 2″ upwardly to separate the base from the main body. The main bodies may then be nested together for storage or transportation purposes.

A presently preferred embodiment of the invention as illustrated in FIGS. 8–11. Referring to FIG. 8, it will be noted that the barricade is formed of two separable elements, an upper body 60 and a lower body 62. The lower body 62 includes a horizontally annular sand trough 64 which is open upwardly to the interior of the barricade. The sand trough is located between an internal wall 66 and the vertical external wall 68 which terminates at its upper edge in an annular horizontal flange 70. At the inside edge of the flange 70 there is a cylindrical vertical wall 72 provided with a circumferential indentation 74.

The upper body 60 has a lowermost portion 76 which telescopically fits over the cylindrical wall 72 of the lower portion and has an internal circumferential projection 78 which snaps into the indentation 74 to hold the two portions of the barricade together. The lower edge of the portion 76 rests on the horizontal flange 70 and receives support therefrom.

The main external walls of the barricade are tapered in a stepped fashion, with a series of cylindrical portions 80, 82, 84, 86 and 88 having progressively reduced diameters. The portions 82 and 86 have bands of light-reflective tape 90 and 92 located on their exterior surfaces to conform with current safety standards.

At the uppermost end of the upper portion 60 there is a cap which is molded to provide a central recess 94 which can support and retain light flasher units of varying sizes and types, radiating notches 96 which can receive and support beam-type barricades shown in broken lines at 98, and a handle 100 which has recesses 102 in its opposite faces to facilitate lifting of the devices.

Referring to FIG. 9, it will be seen that there are three of the radiating notches 96 so that the beams 98 supported thereby may extend in alignment with or at right angles with respect to each other, permitting different patterns to be set up by using appropriately positioned groups of barricades.

FIG. 11 is a partial view of two barricades nested together wherein it will be seen that the lower edge of the sand trough of an upper barricade rests on the horizontal flange 70 of the next lower barricade, thereby limiting the extent of nesting movement so that the barricades do not become wedged together. Also, it will be noted that the internal edge of the sand trough of the upper barricade is carefully dimensioned so as not to contact the next lower barricade and interfere with the nesting movement. With this particular construction, it is possible to nest a plurality of the barricades together without removing the sand in the trough 64.

A desirable feature of the construction shown in FIGS. 8–11 is that, when struck by a vehicle, the upper portion of the barricade may release from the weighted lower portion thereof, so that upon impact only the light-weight upper portion will be thrown into traffic or at bystanders. The detachment between the lightweight upper portion and the weighted lower portin occurs when the projection 78 snaps out of the recess 74. Under many types of blows, the upper section of the barricade will not be damaged by such an impact, nor will serious damage be imposed upon the vehicle. It is a simple procedure simply to snap the lightweight upper section of the barricade back onto the weighted lower section thereof.

When the barricade of FIGS. 8–11 is only subjected to a light blow, the force of impact may be such that the two sections do not become separated. In such an instance, the internal location of the sand trough 64 becomes advantageous since all of the sand remains within the barricade and it may be easily distributed back into the trough without a substantial loss of the weighting means.

From the foregoing, it will be recognized by those skilled in this art that there is a new barricade device which is useable in situations which demand a steel drum, but which is superior in many respects to the steel drum barricades currently in use. The same principles shown in the preferred embodiments may also be utilized in alternative forms of the apparatus and, therefore, the invention is not to be construed only as relating to the devices described but to other apparatus which embodies the principles and spirit of the claims which follow.

We claim:

1. A highway barricade comprising a main body having upright sidewalls symmetrically arranged about a central vertical axis, said sidewalls having opposed portions horizontally spaced about 2 feet apart, said sidewalls converging upwardly toward said axis to permit nesting of a plurality of identical main bodies, weighting means connected to a lower portion of the main body to stabilize the barricade and prevent its tipping when subjected to horizontally directed forces, said weighting means being a trough substantially coextensive with the sidewalls for receiving a weighting material, said trough being open upwardly to the interior of the barricade and having an inner wall inclined upwardly and inwardly, with the extent of inward extension of said inner wall being less than that which would contact the entire periphery of an identical barricade nested therewithin, and a stop means for supporting an identical unit nested thereon to prevent wedging together of the sidewalls.

2. The highway barricade of claim 1 having an upper wall provided with receptacle means for receiving a housing of a light flasher unit.

3. The barricade of claim 1 wherein said upright sidewalls are provided with a plurality of faces which are oriented to reflect rays of light.

4. A highway barricade comprising, a main body having upright sidewalls symmetrically arranged about a central vertical axis, said sidewalls having opposed portions horizontally spaced about 2 feet apart, said sidewalls converging upwardly toward said axis to permit nesting of a plurality of identical main bodies, weighting means connected to a lower portion of the main body to stabilize the barricade and prevent its tipping when subjected to horizontally directed forces, said weighting means being a trough substantially coextensive with the sidewalls for receiving a weighting material, said trough being open upwardly to the interior of the barricade and having a stop means for supporting an identical unit nested thereon to prevent wedging together of the sidewalls, said stop means being a horizontal flange located directly above the trough, said trough having an outer wall connected to the outer edge of the horizontal flange.

5. The highway barricade of claim 4 having an upper wall provided with receptacle means for receiving a housing of a light flasher unit.

* * * * *